United States Patent [19]

Ramsauer

[11] Patent Number: 5,044,677

[45] Date of Patent: Sep. 3, 1991

[54] BAR GUIDEWAY FOR THE FLAT STRIP BARS OF A BAR CLOSURE

[76] Inventor: Dieter Ramsauer, Am Neuhauskoten 20, D-5620 Velbert 11, Fed. Rep. of Germany

[21] Appl. No.: 214,732

[22] PCT Filed: Sep. 12, 1987

[86] PCT No.: PCT/DE87/00412

§ 371 Date: May 25, 1988

§ 102(e) Date: May 25, 1988

[30] Foreign Application Priority Data

Sep. 25, 1986 [DE] Fed. Rep. of Germany ..... 86113170

[51] Int. Cl.[5] ..... E05L 1/06

[52] U.S. Cl. ..... 292/39; 292/142; 292/337

[58] Field of Search ..... 292/32, 33, 34, 39, 292/40, 142, DIG. 53, DIG. 42, 337

[56] References Cited

U.S. PATENT DOCUMENTS

| | | | |
|---|---|---|---|
| 4,002,360 | 1/1977 | Frank et al. | 292/142 X |
| 4,063,763 | 12/1977 | Van Heryten | 292/39 |
| 4,616,864 | 10/1986 | Douglas | 292/39 X |

FOREIGN PATENT DOCUMENTS

| | | | |
|---|---|---|---|
| 35175 | 9/1981 | European Pat. Off. . | |
| 176890 | 4/1986 | European Pat. Off. . | |
| 283659 | 9/1988 | European Pat. Off. | 292/39 |
| 1735288 | 12/1971 | Fed. Rep. of Germany | 282/142 |
| 2335426 | 1/1975 | Fed. Rep. of Germany . | |
| 2516303 | 11/1975 | Fed. Rep. of Germany | 292/142 |
| 2654591 | 6/1978 | Fed. Rep. of Germany . | |
| 3300976 | 7/1984 | Fed. Rep. of Germany | 292/39 |

*Primary Examiner*—Eric K. Nicholson
*Attorney, Agent, or Firm*—Darby & Darby

[57] ABSTRACT

A bar guideway for the flat strip bar (18) of a bar closure (14) is described which is intended for installation in the fillet gap of sheet metal cabinet doors, and the flat strip bar (14) does not carry any or only tediously dissemblable locking means such as pins, hooks, roll pins or double roll pins. According to the invention, the bar guideway (20) forms a base angle (60) of resiliently elastic material such as synthetic material, whose one leg (62) has a fastening hole (64) and whose other leg (66) has one projecting rail (72 respectively 74) each. Each rail has a hook-shaped profile, and thereby forms a guide track (76) for the flat strip bar (18) (FIG. 1 and 6).

19 Claims, 4 Drawing Sheets

BAR GUIDEWAY FOR THE FLAT STRIP BARS OF A BAR CLOSURE

BACKGROUND OF THE INVENTION

1. Field of the Invention

The invention relates to a bar guideway for the flat strip bar of a bar closure which in particular is provided for installation in the fillet gap of sheet metal cabinet doors and in which the flat strip bar does not have any or has only tediously disassemblable locking means such as pins, hooks, roll pins or double roll pins.

2. Prior Art Background

A bar guideway for the flat strip bar of a bar closure, which is arranged in the fillet gap of sheet metal cabinets, is known from European Patent 01776890. The bar guideway described there is provided with recesses and functions to guide the bars and for locking, e.g. for accepting a peg carried by the body of the cabinet upon the sheet metal cabinet door being closed. Subsequently, an axial section of the flat strip bar slides onto said bar guideway and brings about locking. This yields a relatively stable locking. However, this kind of locking requires very precise installation of the bar guideway and requires the bolt to be received by the bar guide, so that the door can be closed properly. In addition, another disadvantage is that locking can only take place at the ends of the bar should the bar of the bar closure be intended for right as well as for left closing doors. For example, greater sheet metal cabinet heights and greater loads, through the explosion pressure of arcs within the switch cabinet. It can, however, become necessary, to fix the door panel not only above and below, but also at intermediate levels, which, with the known bar closure, cannot be realized at all or only by accepting other disadvantages such as nonsymmetry cf the bars of the bar closure.

A further disadvantage of the known bar guideway is that the bar can only be introduced into the guideway by sliding it axially from above or below. With particular constructions of the bar closure, this can lead to difficulties or it can be completely impossible.

A further disadvantage of the subject matter of the above-mentioned publication is that no explanation is given regarding the method by which the bar guideway is fastened on the door panel.

SUMMARY OF THE INVENTION

It is the task of the invention to further develop a bar guideway so that the kind of fastening on the door panel becomes clear. In particular, the bar guideway does not need to be slid onto the bar axially, nor does the bar need to be slid axially into the bar guideway, but rather the bar guideway can be slid laterally onto the bar. The bar guideway can be clipped on or applied in a similar fashion, so that sliding the entire bar axially through the bar guideway become superfluous.

This task is solved by implementing one of two alternative constructions. In the first alternative, the bar guideway has an L-shaped cross-section of resiliently elastic material such as synthetic material The bar guideway has a pair of legs extending from a corner area so that the legs and corner area together form the L-shaped cross-section. One leg has a fastening hole and the other leg has a free edge. Extending from the free edge and from the corner area are projecting guide rails each with a hook-shaped profile, which forms a guide track in which is guided the flat strip bar. The second alternative, fulfills the same task. However, the bar guide comprises a first L-shaped corner piece, of which is provided with a first aperture or cut for receiving the set bolts for fastening the screws on the door panel corner and the other leg forms a guideway for the surface of the flat strip bar directed away from the door panel corner. The bar also comprises a second L-shaped cornerpiece, one leg of which is provided with a second aperture for fastening with screws to the first angle, and the other leg of which forms a guideway for the other surface of the flat strip bar lying toward the door panel corner and forms at the end a hook reaching around the one narrow side of the flat strip bar.

Both solutions have the advantage that the flat strip bar they are to carry does not need to be slid through, but can be stuck onto the bar laterally and subsequently be installed on the door panel. In many applications this simplifies installation of the flat strip bar closure. Thus, the installation of flat strip bar closures becomes possible, which, due to the construction of the flat strip bars, cannot even be pushed through guideways.

Both approaches permit different embodiments. In the kind of bar guideway mentioned first, bilateral reinforcing walls can be arranged within the frame surrounded by the legs, which is of an advantage, if the bar guideway is injection molded of synthetic material.

According to a yet different embodiment, it is desirable for foot rails, which continue and widen the walls, to extend from the outer surface of the leg carrying the fastening hole. This ensures improved contact when fastening with welding bolts, because welding material residues do not become a nuisance.

The hook rail fastened at the angle corner region can have an offset region of lesser cross section. The decreased cross section could, for example, be formed by a triangular groove, with the tip of the triangle lying near the associated inner corner of the guide track. In particular, the hook rail fastened on the angle corner region could form a resilient clip, the one end of which braces itself on the fastening surface for the bar guideway.

According to a yet different embodiment, the bar guideway may be formed in such a way that the outer angle surface around the fastening hole forms an undercut for receiving the bore ridge (for screw fastening) or welding material (for welding bolt fastening). Preferably, the leg forming the guide track has a greater axial extent than the leg provided with the fastening hole.

According to yet another embodiment, the reinforcing walls and/or the side edges of the leg or the extended guide track may form a stopping surface for a locking part carrying the bar. However, a stopping surface can be provided which also represents an alignment projection for a locking part carried by the door frame. The door edge has a labyrinth for water-repelling ventilatability. The door edge of the door (instead of a rubber seal which acts as stop) never makes contact directly with the surface of the unlacquered frame which would otherwise possibly damage the lacquer. Instead, a defined distance by the stopping devices is maintained.

The alternative construction likewise permits several variations, which can be used to advantage. The second aperture or the cut could be arch-shaped and have a radius significantly greater than that of the fastening bolt in order to receive here flashing, welding residues or the like and, in this way, effect full contact of the bar guideway on the door panel. The advantage of the arch-shaped cut (compared to a round hole of identical radius) lies in its simple installation: the first L-shaped corner piece can subsequently be pushed under the second L-shaped corner piece, which is already placed on the screw bolt or similar means. Before the second L-shaped corner piece is inserted, the flat strip bar can still be slid under the hook of the second angle.

Furthermore, for more precise guidance of the one narrow edge of the flat strip bar, it is, favorable if the second L-shaped corner piece forms in its second leg, which is directed away from the door panel plane, a cut, from which extends a guide lug or a guide web for the one narrow side of the flat strip bar. This guide lug or guide web can be created by bending the leg end inward by 90° in the region of the cut or by cutting all the way into the other leg and bending out an auxiliary leg parallel to the second leg but by a shorter fashion and displaced toward the inside. The two parts may be punched out of metal, injection molded of light metal, cast, or partially injection molded of synthetic material.

BRIEF DESCRIPTION OF THE DRAWINGS

Below, the invention is explained in greater detail in conjunction with embodiments represented in the drawings, which show.

DETAILED DESCRIPTION OF THE PREFERRED EMBODIMENT

Figure 1:
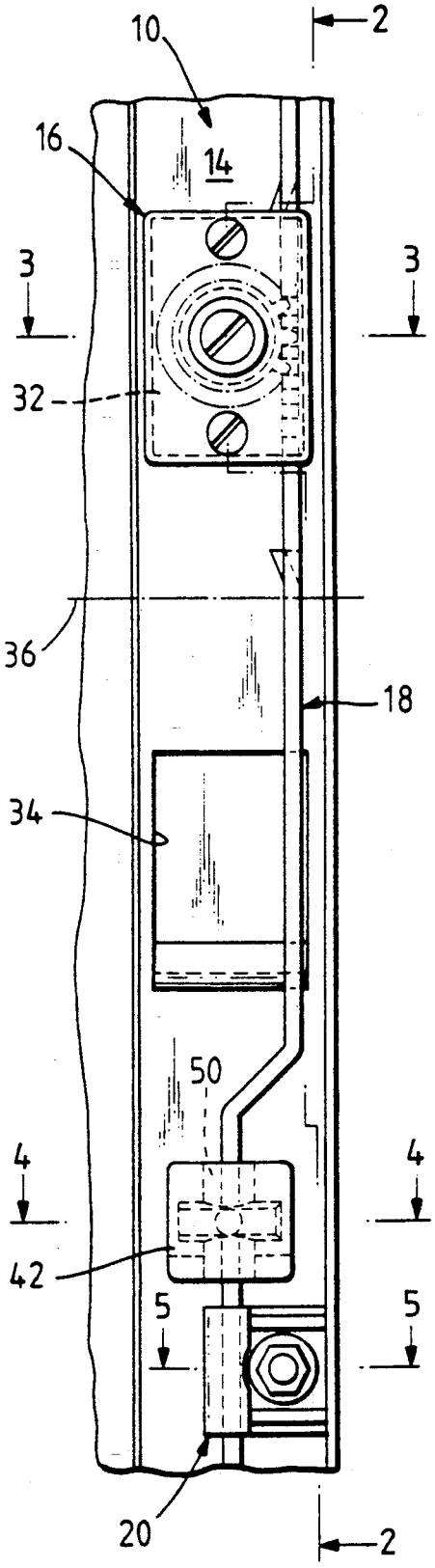
FIG. 1 is a side elevational view of the fillet gap of a sheet metal cabinet door as viewed from behind with a flat strip bar closure installed in this fillet gap as an explanation of the application of the bar guideway according to the invention.
Figure 3:
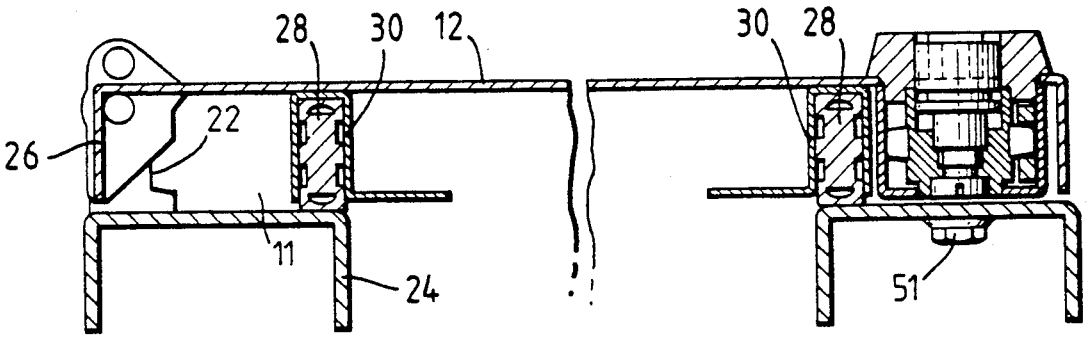
FIG. 3 is an axial sectional view along line 3—3 of FIG. 1.

FIG. 1 shows the fillet gap or channel 10 of a sheet metal cabinet door 12 in a view from behind the door 12. A bar closure 14 arranged in this gap consists of a lock 16, from which a flat strip bar 18 extends in this fillet gap 10. The flat strip bar 18 is supported within the lock 16 and is also displacably supported in a bar guideway 20 on the door panel 12. The sheet metal cabinet door 12 is, as shown in FIG. 3, articulated in a known manner with joint hinges 22 and with the body of the cabinet 24, which, in turn, utilizes the other fillet gap 11, which is formed between the outer edge 26 of door 12 and a sheet metal section 30 welded to the inside of the door panel 12 and a sheet metal section 30 welded to the inside of the door panel 12 and sealed by a seal 28. In sheet metal cabinets, which have a fillet gap 10, 11 of this nature, it is customary that in the fillet gap for the closure one or, if use of sinkable pivot lever closures is planned, two rectangular apertures 32 and 34 are arranged symmetrically to the horizontal door center 36.

Figure 2:
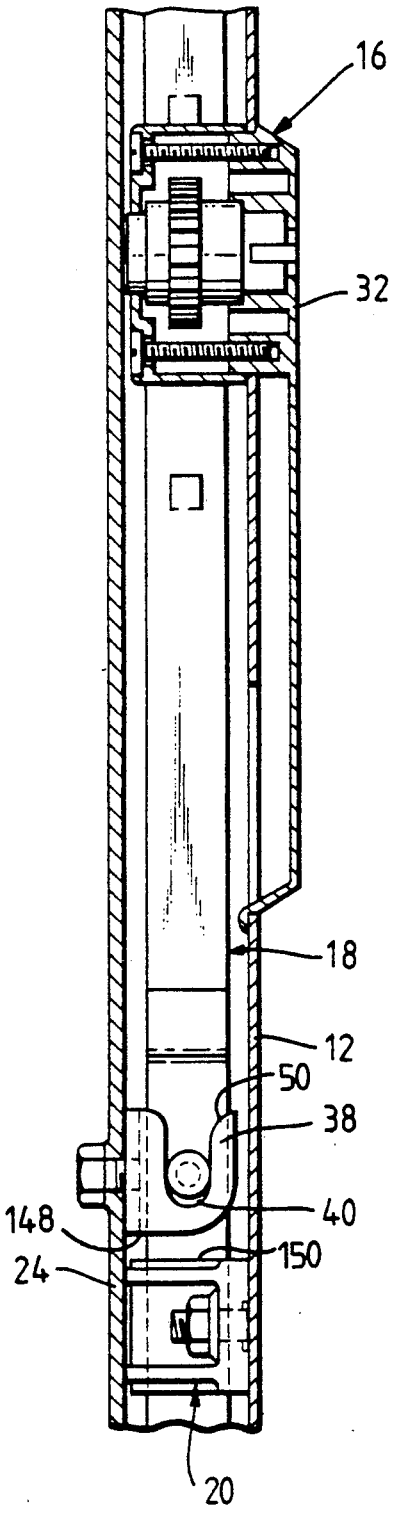
FIG. 2 is an axial sectional view along line 2—2 of FIG. 1.

As shown in FIG. 2, which represents an axial sectional view along line B—B of FIG. 1, a hook-like projection 38 is screwed to the body of the cabinet 24, into which, when the bar closure is closed, a double roll pin 40 carried by the closure bar penetrates and forms a lock arrangement 42. In the sectional view C—C through this locking arrangement (see FIG. 4), it can be seen that the bar 18, which is rectangular in cross section and formed of flat strip material, carries a peg 44 in press fit, which holds bilaterally rotatable rollers 46. The rollers have so much play that they are readily rotatable but cannot slide off the peg 44; this is due to the presence of a head 48 on the one side of peg 44, and a flange (beading) 52, which is generated on the opposite side of the peg after the peg and rollers have been installed.

Figure 4:
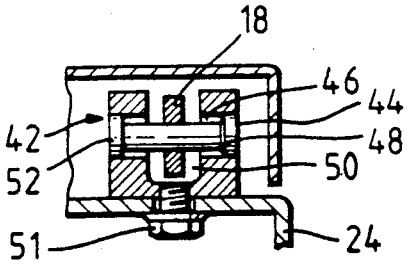
FIG. 4 is an axial sectional view along line 4—4 of FIG. 1 as an illustration of a locking device for a flat strip bar, so that it is not slidable through the guide device.

The hook 38 is provided with a slit 50 for receiving the bar 18, within section C—C of FIG. 4. The hook has a U-shaped profile, with the web of the U having a threaded bore, into which a setscrew 51 can be screwed in order to fix the hook 38. The hook 38 may also have a safeguard against rotation. For example, a prismatic aperture in the body of the cabinet 24, into which corresponding projections of the hook can be slid forming a safeguard against rotation.

Figure 5:
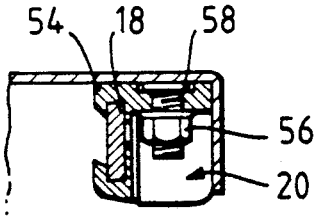
FIG. 5 is an axial sectional view along line 5—5 of FIG. 1 to represent the embodiment of a bar guideway according to the invention used in FIG. 1.
Figure 6A:
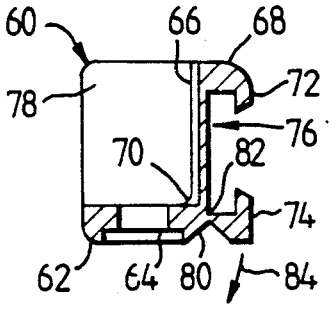
FIGS. 6 A-C are respectively side elevational, axial sectional and bottom views of the bar guideway according to FIG. 5.
Figure 6B:
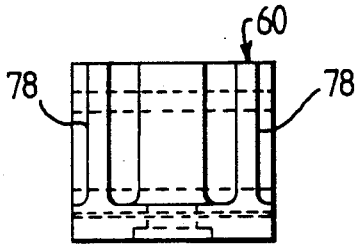
Figure 6C:
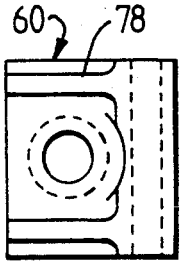

FIG. 5, which is the sectional view D—D according to FIG. 1, shows a bar guideway 20, in which a part, still to be described in detail and preferably injection molded of synthetic material, is arranged in a rotation-proof fashion with a stud bolt arrangement in the corner gap of the fillet gap 10. The part is formed so that the flat strip bar 18, after having been previously bent away from projection 54, can be slid into the guideway. Subsequently, the fastening nut 56 of the welding bolt 58 can be tightened, which presses the projection 54 against the bar 18 forming a safeguard. The guideway 20 can also be arranged on the other side of bar 18 outside the corner region of the door panel where it is occasionally difficult to access for welding work. In this case the bottom support of the bar guideway 20 could have small projections which would increase friction, so that the separate rotation safeguard, advisable for welding bolt fastening, is achieved. In FIGS. 6A-C, the bar guide part, which is injection molded of synthetic material and used in FIG. 5, is again emphasized more clearly. As can be seen, the bar guideway 20 consists of a base angle 60 of resiliently elastic material, in particular synthetic material, the one leg 62 of which has a fastening hole 64 and the other leg 66 of which has at its edge 68, which is free in the upward direction, and in the angle region 70 between the two legs 62, 66 one projecting rail 72. Each rail has a hook-shaped profile and, in this way, forms a guide track 76 for the flat strip bar.

Reinforcing walls 78 are arranged on both sides of the fastening hole 64 within the angle, which if produced on an elastic synthetic material, lend sufficient strength to the overall arrangement.

The hook-shaped rails 72, 74 are bent obliquely at their hook ends toward the outside and facilitate through their funnel shape the insertion of the flat strip bar. As a supplement, as shown in FIG. 6B, the hook rail 74 fastened at the angle corner region 70 can have an offset of lesser cross section, with this lesser cross section being formed, for example, by a triangular groove 80, with the tip of the triangle lying near the associated inner corner 82 of the guide track 76. During insertion, before installing the base angle 60 or at least before tightening the particular fastening screw, the hook rail 74 can be folded away in the direction of arrow 84 and the bar slid into the upper hook. Subsequently, the rail 74 (which represents the projection 54 according to FIG. 5) can be folded back again, whereupon the base angle 60 is fastened in the region of the corner. The fold-away hook 74 is simultaneously held firm by the bottom surface (see FIG. 5) of the door panel.

Figure 7A:
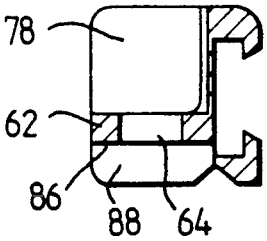
FIGS. 7 A-C are views similar to those of FIGS. 6A-C but for another embodiment.
Figure 7B:
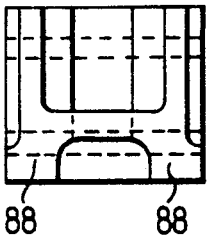
Figure 7C:
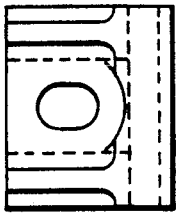
Figure 8:
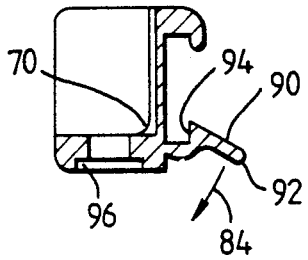
FIG. 8 is a sectional representation of still another embodiment, but which is similar to FIG. 5.

As shown in FIGS. 7A–C, which is an embodiment similar to FIGS. 6A–C, foot rails 88 continuing and widening the walls 78 can extend from the outer surface 86 of the leg 62 carrying the fastening hole 64. The advantage of this construction is more space for receiving the ridge or welding residues is available, when welding bolts are used for fastening. I n FIG. 8, which is an embodiment in a model similar to that of FIG. 6 A–C, a base angle for a bar guideway is shown in which the hook rail fastened on the angle corner region 70 forms a resilient clip 90, the end 92 of which braces itself on the fastening surface (not shown here) for the bar guideway, so that the swing-away motion cannot take place in the direction of arrow 84. However, this clip-like design 90 is so elastic, that even after installation, sufficient resiliency exists in order to slide the flat bar in at the top and subsequently achieve over the run-up surface of clip 90 insertion at the bottom, with the clip giving so far, that the bar clicks in behind the corner 94 and, subsequently, is held tight.

Figure 9:
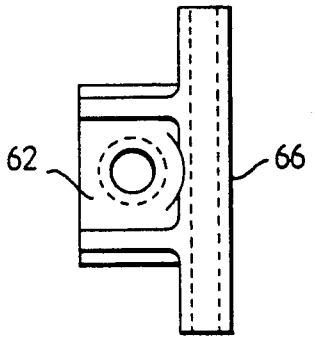
FIG. 9 is a plan view of an embodiment of the bar guideway according to FIG. 6C in a modification.
Figure 11:
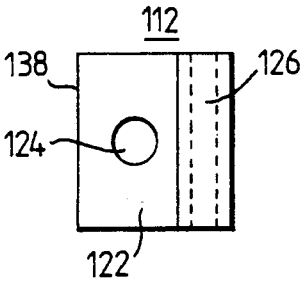
FIG. 11 is the upper part of the FIG. 10 bar guideway in a separate representation.

FIG. 9 shows that the leg 66 forming the guide channel may extend greater axially than the leg 62 provided with the bore. The bar guideway is preferably formed so that the outer angle surface again forms around the bore an undercut 96 for receiving bore ridges (when fastening takes place with screws) or welding material (when fastening is done with welding bolts).

In FIGS. 10 to 14 a bar guideway is shown consisting of two parts.

The first part comprises a first angle 110 with one leg 114 provided with an arch-shaped cut 116 for fastening with screws in the corner gap of the door panel to receive the fastening bolt 58, and the other leg 118 forms a guideway for the surface 120 of the flat strip bar 18 directed away from the door panel corner gap. The second part comprises a second angle 112 (FIG. 11) with one leg 122 provided with a round bore 124 for fastening with screws to the first angle 110, and the other leg 126 forming a guideway for the other surface 128 of the flat strip bar lying toward the door panel corner gap. At the end of this other leg forms a hook 132 encompassing the narrow side 130 of the flat strip bar 18.

Figure 12:
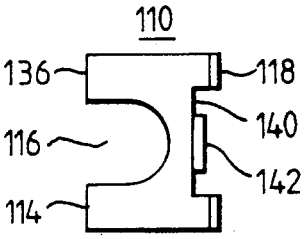
FIG. 12 is a plan view of the lower part of the FIG. 10 bar guideway.
Figure 10:
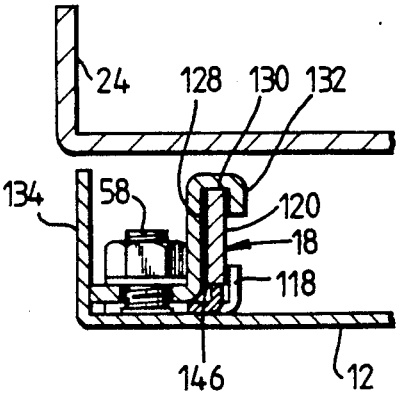
FIG. 10 is a representation similar to FIG. 5 of another embodiment of a bar guideway, which consists of two parts.
Figure 14:
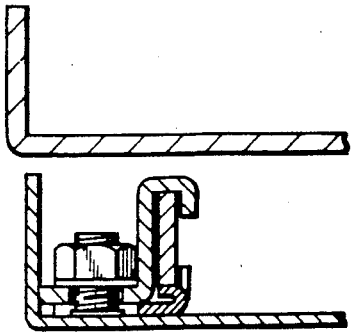
FIG. 14 is a representation of bar guideway similar to FIG. 10 with the modified lower part according to FIG. 13.

As is readily apparent in FIG. 12, the arch-shaped cut 116 has a radius substantially greater than that of the round aperture 124 of angle 112 adapted to the radius of the fastening bolt, again for the purpose of receiving flashing, welding residues or the like and to permit full contact of the angle on the fastening surface within the corner gap of the door panel. As FIG. 10 shows, the bend 134 of the door panel 12 provides a stopping surface for the free edges 136 of the two angles 110, 112 and an excellent safeguard against rotation in connection with the tightened screw bolt connection 58. A closed aperture (round hole) with identical radius can also be provided instead of the arch-shaped cut. However, in that case, installation of both angles can only take place simultaneously (with the flat bar inserted). The cut permits installation of the second angle, flat strip bar, and first angle in separate steps, which can be of advantage.

Figure 13:
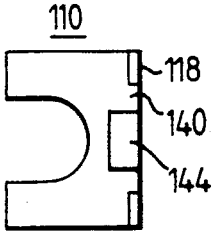
FIG. 13 is a plan view of a somewhat modified lower part of FIG. 12.

As seen in FIG. 13, the first angle 110 can form a cut 140 in its second leg 118 directed away from the door panel plane. From this cut extends a guide lug or guide web 142 (FIG. 12) or 144 (FIG. 13) for the other narrow side 146 of the flat strip bar 18. The guide lug or the guide web can be generated by bending the leg end in the region of the cut inward by 90° (see FIG. 13 and 14), or by cutting all the way into the other leg 136 and bending out an auxiliary leg parallel to the second leg 118 but shorter and displaced toward the inside (see FIG. 12 and FIG. 10). The advantage of both constructions is that the flat strip bar 18 receives a somewhat greater distance from the door panel 12, which can be of advantage with respect to other devices of the bar closure.

The two parts 110, 112 shown in FIGS. 10 to 14 can be punched out of metal or produced of synthetic material.

In general, it is favorable to attach the bar guideway 20 as near as possible to one of the closure hooks 38, in order to keep as small as possible the lever forces acting upon the flat strip bar. If the two parts 20, 38 respectively are moved even closer to each other as is shown in FIG. 2, the lower part 148 of hook 38 braces itself on a corresponding bearing surface 150 of the bar guideway 20 and results in a particularly precise guidance of the door panel with respect to the door frame. The guidance is as precise as is obtained with different means in prior art. Particularly, the hook 38 is clamped between the surface 150 of the bar guideway 20 and the double roll pin 40, so that an extraordinarily shakeproof closing effect is achieved. Depending on the construction of the bar guideway 20, the reinforcing wall 78, the side edges of leg 68 or, in FIG. 9, the front face of the extended guide channel should be considered as a bearing surface.

Special alignment projections, which extend from the door frame 24, can be provided instead of hook 38 as an alignment device, which, in connection with the bar guideway 20, accomplishes fixing the door panel with respect to the door frame in the closed state.

Bar guideways of the described kind are used in the electrical industry for building closures for switch cabinets manufactured of sheet metal.

I claim:

1. A bar guideway for a flat strip bar of a bar closure, which is provided for installation in a fillet gap of a cabinet door, comprising of a pair of legs extending away from a corner area so that said legs and said corner area together have an L-shaped cross-section, one of said legs having a fastening hole, the other of said legs having a free end from which extends one projecting hook rail with a hook-shaped profile, another projecting hook rail with a hook-shaped profile extending from said corner area, both of said hook rails cooperating with each other to form a guide track for guiding the flat strip bar therebetween, both of said hook rails extending outward from said other leg and corner area, respectively, in a direction which is opposite to a direction in which extends said leg with said fastening hole away from said corner area.

2. A bar guideway as in claim 1, wherein said other of said legs extends greater in an axial direction than does that one of said legs which is provided with the fastening hole.

3. A bar guideway for a flat strip bar of a bar closure, which is provided for installation in a fillet gap of a cabinet door, comprising a pair of legs extending away from a corner area so that said legs and said corner area together have an L-shaped cross-section, one of said legs having a fastening hole, the other of said legs having a free end from which extends one projecting hook rail with a hook-shaped profile, another projecting hook rail with a hook-shaped profile extending from said corner area, both of said hook rails together cooperating with each other to form a guide track for guiding the flat strip bar therebetween; and reinforcing walls in a space defined between the legs on both sides of the fastening hole.

4. A bar guideway as in claim 3, wherein from an outer surface of the leg carrying the fastening hole, foot rails extend which widen the walls.

5. A bar guideway as in claim 3, wherein the reinforcing walls and side edges of the leg with the fastening hole form a stopping surface for a locking part carried by the bar.

6. A bar guideway for a flat strip bar of a bar closure, which is provided for installation in a fillet gap of a cabinet door, comprising a pair of legs extending away from a corner area so that said legs and said corner area together have an L-shaped cross-section, one of said legs having a fastening hole, the other of said legs having a free end from which extends one projecting hook rail with a hook-shaped profile, another projecting hook rail with a hook-shaped profile extending from said corner area, both of said hook rails together cooperating with each other to form a guide track for guiding the flat strip bar therebetween, said another projecting hook rail having an offset region of decreased cross section.

7. A bar guideway as in claim 6, wherein the decreased cross section is formed by a triangular groove, with one point of the triangle lying closer to an associated inner corner of the guide track than the remaining points of the triangle.

8. A bar guideway as in claim 6, wherein the another projecting hook rail forms a resilient clip, an end of which braces on a fastening surface for the bar guideway.

9. A bar guideway for a flat strip bar of a bar closure, which is provided for installation in a fillet gap of a cabinet door, comprising a pair of legs extending away from a corner so that said legs and said corner area together have an L-shaped cross-section, one of said legs having a fastening hole, the other of said legs having a free end from which extends one projecting hook rail with a hook-shaped profile, another projecting hook rail extending from said corner area, both of said hook rails together cooperating with each other to form a guide track for guiding the flat strip bar therebetween; and an undercut in a region around the fastening hole for receiving a fastening element.

10. A bar guideway for a flat strip bar of a bar closure, which is provided for installation in a fillet gap of a cabinet door, the bar guideway comprising a first L-shaped corner element formed by a first pair of legs extending from a first corner area, one of said legs having a first aperture for receiving a fastening element, the other of said legs having a free end from which extends a projecting strip which has a hook-shaped profile, a second L-shaped corner element formed by a second pair of legs extending from a second corner area, a first leg of the second pair of legs being provided with a second aperture for receiving another fastening element, and a second leg of the second pair of legs forming a strip with a hook-shaped profile which projects beyond the first corner area to cooperate with the hook-shaped profile of the first L-shaped corner element so that the flat strip bar is guided between the hook-shaped profiles of each of the first and second L-shaped corner elements, both of said hook-shaped profiles extending outward in a direction which is opposite to a direction in which extends said legs which have a respective one of said first and second apertures.

11. A bar guideway as in claim 10, wherein the first aperture is an arch-shaped cut and the second aperture is a round bore accommodating the associated fastening bolt therein.

12. A bar guideway as in claim 10, wherein the bar guideway has parts punched out of metal.

13. A bar guideway as in claim 10, wherein the bar guideway has at least one part injection molded of synthetic material.

14. A bar guideway for a flat strip of a bar closure, which is provided for installation in a fillet gap of a cabinet door, the bar guideway comprising a first L-shaped corner element formed by a first pair of legs extending from a first corner area, one of said legs having a first aperture for receiving a fastening element, the other of said legs having a free end from which extends a projecting strip which has a hook-shaped profile, a second L-shaped corner element formed by a second pair of legs extending from a second corner area, a first leg of the second pair of legs being provided with a second aperture for receiving another fastening element, and a second leg of the second pair of legs forming a strip with a hook-shaped profile which projects beyond the first corner area to cooperate with the hook-shaped profile of the first L-shaped corner element so that the flat strip bar is guided between the hook-shaped profiles of each of the first and second L-shaped corner elements, the first aperture being an arch-shaped cut and the second aperture being a round bore accommodating the associated fastening bolt therein, said arch-shaped cut having a radius greater than that of the round bore.

15. A bar guideway for a flat strip of a bar closure, which is provided for installation in a fillet gap of a cabinet door, the bar guideway comprising a first L-shaped corner element formed by a first pair of legs extending from a first corner area, one of said legs having a first aperture for receiving a fastening element, the other of said legs having a free end from which extends a projecting strip which has a hook-shaped profile, a second L-shaped corner element formed by a second pair of legs extending from a second corner area, a first leg of the second pair of legs being provided with a second aperture for receiving another fastening element, and a second leg of the second pair of legs forming a strip with a hook-shaped profile which projects beyond the first corner area to cooperate with the hook-shaped profile of the first L-shaped corner element so that the flat strip bar is guided between the hook-shaped profiles of each of the first and second L-shaped corner elements, the other leg of the first and second L-shaped corner element having a slot extending away from a plane passing through a door panel, from which a guide element extends for a side of the flat strip bar.

16. A bar guideway as in claim 15, wherein the guide element is formed by bending the leg end in the region of the cut inward by 90°.

17. A bar guideway as in claim 15, wherein the guide element is formed by a bend of an auxiliary leg parallel to the other leg but which is shorter than the second leg.

18. A bar guideway as in claim 15, wherein the guide element is formed by a cut in the one leg.

19. A bar guideway for a flat strip of a bar closure, which is provided for installation in a fillet gap of a sheet metal cabinet door, the bar guideway comprising a pair of legs extending from a corner area so that said legs and said corner area together have an L-shaped cross-section, one of said legs having a fastening hole, the other of said legs having a free edge from which extends one projecting hook rail with hook-shaped profile, both of said hook rails together cooperating with each other to form a guide track for guiding the flat strip bar therebetween, the pair of legs being composed of resiliently elastic material.

* * * * *